United States Patent [19]

Tamaru et al.

[11] Patent Number: 4,903,642

[45] Date of Patent: Feb. 27, 1990

[54] APPARATUS FOR CONTROLLING INJECTION OF CHEMICAL LIQUID IN BOILER SYSTEM

[75] Inventors: Nobuhiro Tamaru; Tadao Jujita, both of Tokyo, Japan

[73] Assignee: Ebara Corporation, Tokyo, Japan

[21] Appl. No.: 255,194

[22] PCT Filed: Dec. 15, 1987

[86] PCT No.: PCT/JP87/00979

§ 371 Date: Oct. 12, 1988

§ 102(e) Date: Oct. 12, 1988

[30] Foreign Application Priority Data

Dec. 17, 1986 [JP] Japan ..... 61-300654

[51] Int. Cl.[4] ..... F22B 37/48; F28G 9/00

[52] U.S. Cl. ..... 122/401; 210/177

[58] Field of Search ..... 122/451 R, 401; 210/138, 177

[56] References Cited

FOREIGN PATENT DOCUMENTS 50-94303 7/1975 Japan .
51-12002 1/1976 Japan .
53-74604 7/1978 Japan .
59-24101 2/1984 Japan .
61-34310 3/1986 Japan .

OTHER PUBLICATIONS

"Water Control in Boilers", by Japan Boiler Association, Oct. 15, 1967, pp. 179–189.

*Primary Examiner*—Edward G. Favors
*Attorney, Agent, or Firm*—Armstrong, Nikaido, Marmelstein, Kubovcik & Murray

[57] ABSTRACT

An apparatus for controlling injection of a chemical liquid in which the chemical liquid is basically injected into a boiler (1) filled with can water by actuating a chemical liquid supplying means (5) for a basic injection period (T2). After the basic injection period (T2) has passed, an accumulative operating period (T3) of water supplying means (4) is measured. During a period for which the accumulative operating period (T3) is smaller than the basic injection period (T2), the supply of chemical liquid is inhibited. When the accumulative operating period (T3) becomes greater than the basic injection period (T2), the chemical liquid is injected at a constant ratio to an amount of water supplied.

2 Claims, 4 Drawing Sheets

APPARATUS FOR CONTROLLING INJECTION OF CHEMICAL LIQUID IN BOILER SYSTEM

DESCRIPTION

1. Technical Field:

The present invention relates to an apparatus for controlling injection of a chemical liquid in a boiler system which includes: a water supply control unit for keeping fluctuations in level of can water within upper and lower limit values, these fluctuations being concomitant with consumption of steam in the boiler system; water supplying means interlocked with and controlled by this water supply control unit; and chemical liquid supplying means, and more particularly, to an improvement in which a pH value and a concentration of can water in the boiler do not increase higher than needed.

2. Background Art:

In the boiler system, corrosion of a boiler can and scale adhesion thereto, which are caused by the action of can water, are typically restrained by injecting a chemical liquid (a rust preventive or a deoxidizer) into the can water. For injection of such a chemical liquid, an apparatus for controlling the injection of the chemical liquid which is illustrated in FIG. 1 has been used.

Referring to FIG. 1, connected to a boiler 1 are a water supplying pump 4 defined as water supplying means and a chemical liquid pump 5 defined as a chemical liquid supplying means to which the chemical liquid is fed from a chemical liquid tank 6. The boiler 1 is equipped with a combustion control unit 7 for controlling combustion so as to keep the vapor pressure of the boiler within a range of upper and lower limit values and a water gauge 11 for detecting upper and lower limit levels of water when controlling the supply of water to the boiler. A water level detecting signal SO can be transmitted from the water gauge 11 to a water supply control unit 3. From this water supply control unit 3, a water supplying signal S1 can be transmitted to the water supplying pump 4 and the chemical liquid pump 5.

In this arrangement, when basic injection of the chemical liquid is automatically or manually effected into the boiler filled with the can water, the pH value of the can water is somewhat increased, and the corrosion of the boiler just after initiating the operation is restrained. Subsequently, after initiating the boiler operation, when the level of can water is reduced down to the lower limit level as the boiler 1 consumes the steam, the water supply control unit 3 supplies the water supplying signal S1 to the water supply pump 4 and the chemical liquid pump 5 in response to the water level signal SO indicating the above-mentioned descent of water level to the lower limit value, and these pumps 4 and 5 are thereby actuated. On the other hand, when the level of can water rises to the upper limit level, the operation is stopped by cutting off the supply of the water supplying signal S1 in response to the water level signal SO indicating the above-described ascent of the can water level to the upper limit value. The water supply control is thus operated in a interlocking manner. The chemical liquid is injected into the can water at a constant ratio by means of the chemical liquid pump 5 concomitantly with the water supply by the water supply pump 4, thereby gradually increasing the pH value of can water, which has already been risen in a certain extent at the time of the basic injection, after starting the boiler operation. In this manner, the corrosion and the scale adhesion which are produced during the boiler operation can be restrained.

Based on the above-described conventional technique, the pH value is increased to a certain degree by effecting the basic injection of chemical liquid into the can water, and the chemical liquid is injected into the can water at the constant ratio to an amount of supplied water concomitantly with the intermittent water supply control after starting the operation. As a result, during continuation of the boiler operation, a concentration of the chemical liquid in the can water rises little by little because of concentration of the can water, and the pH value of the can water also gradually increases.

The restraining action of chemical liquid against corrosion and scale adhesion is generally promoted till the pH value of can water reaches an adequate value, and if the pH value exceeds this proper value, the restraining action remains substantially fixed. Hence, the chemical liquid injection thereafter comes to futile consumption. Besides, the pH value of can water increases to a value higher than is needed in a short period of time when undergoing a high load. In other words, the can water is concentrated and the concentration of chemical liquid excessively rises thereby inducing carry-over, which causes such a problem that the load devices of the boiler are corroded and damaged.

In contrast with this, if the injection of chemical liquid is performed interlocked with the water supply control without performing any basic injection of chemical liquid, it may take a longer time for the pH value of can water to be increased to a proper value by injecting the chemical liquid after initiating the boiler operation at the time of low load. This brings about another problem of antinomy in which the boiler is in a state of low pH value by which the boiler tends to undergo the corrosive action for a long time.

DISCLOSURE OF INVENTION:

In view of the problems presented by the fact that when effecting basic injection of a chemical liquid into the can water by an apparatus for controlling the injection of the chemical liquid in a boiler system based on the conventional technique, the injection of the chemical liquid interlocked with the control of water supply to the boiler causes a pH value to increase higher than needed, which leads not only to waste of chemical liquid, but also induction of carry-over due to the chemical liquid having a high concentration, the present invention is made to solve the above-described problems by providing an apparatus for controlling injection of a chemical liquid with a chemical liquid supply control unit 8, this control unit 8 including: chemical liquid basic injection means 81 for driving chemical liquid supply means 5 for a specific basic injection period T2; basic injection period storing means 82 for setting or clocking the basic injection period T2 for storage; accumulative operating period measuring means 83 for measuring an accumulative operating period T3 of water supply means 4 driven in combination with the control of water supply; time comparing means 84 for comparing the accumulative operating period T3 with the basic injection period T2; and chemical liquid supply stopping means 85 for stopping the operation of the chemical liquid supply means 5 when the accumulative operating period T3 is smaller than the basic injection period T2.

According to a constitution of the present invention, the chemical liquid basic injection control means 81 causes the chemical liquid supply means 5 to function for the basic injection period T2 so that the chemical liquid is basically injected into a boiler 1 filled with can water. The basic injection period storing means 82 clocks and stores the basic injection period T2. After the basic injection period has passed, the accumulative operating period measuring means 83 measures the accumulative operating period T3 of the water supply means 4 concomitant with the control of water supply. The time comparing means 84 compares the measured result with the stored basic injection period T2. The chemical liquid supply stopping means 85 inhibits the interlocking control of the water supply means 4 and the chemical liquid supply means 5 on the basis of the compared result when the accumulative operating period T3 is smaller than the basic injection period T2, and stops the operation of the chemical liquid supply means 5. During the halt of operation only the water supply is performed. The interlocking control of the water supply means 4 and the chemical liquid supply means 5 is initiated when the accumulative operating period T3 has become greater than the basic injection period T2. The chemical liquid is injected at a constant ratio to an amount of water supplied. Accordingly, an amount of chemical liquid greater than required is not injected into the boiler.

In accordance with the present invention, the apparatus for controlling injection of a chemical liquid is equipped with the chemical liquid supply control unit for stopping the operation of the chemical liquid supply means by inhibiting the interlocking control of the chemical liquid supply means and the water supply means during a period for which the accumulative operating period T3 of the water supply means after initiating the operation is smaller than the basic injection period T2 of the chemical liquid before starting the operation. In this arrangement, when controlling water supply after completing the basic injection of chemical liquid, the supply of chemical liquid after the basic injection period is cut off during a period required for the accumulative operating period T3 of the water supply means to coincide with the chemical liquid basic injection period T2, i.e., a period needed if an amount of chemical liquid equal to the total quantity of chemical liquid supposed to be supplied from the chemical liquid supply means to the boiler for the basic injection period T2 is fed to the boiler by the interlock of the water supply means and the chemical liquid supply means after the basic injection period T2 has passed. This enables both the pH value of the can water and the concentration of chemical liquid during such a period to maintain to the values shown at the time of completing the basic injection. This results in such excellent effects that excessive corrosion due to the operation at a low pH value of the can water immediately after being filled can be prevented, and that it is feasible to simultaneously eliminate the inducement of carry-over derived from the concentrated can water and the excessive corrosion resulted from the operation at a high pH value of the can water at the time of high load.

BEST MODE FOR CARRYING-OUT THE INVENTION

The constitution of an embodiment of the present invention will hereinafter be described with reference to FIGS. 2 to 4.

Figure 1:
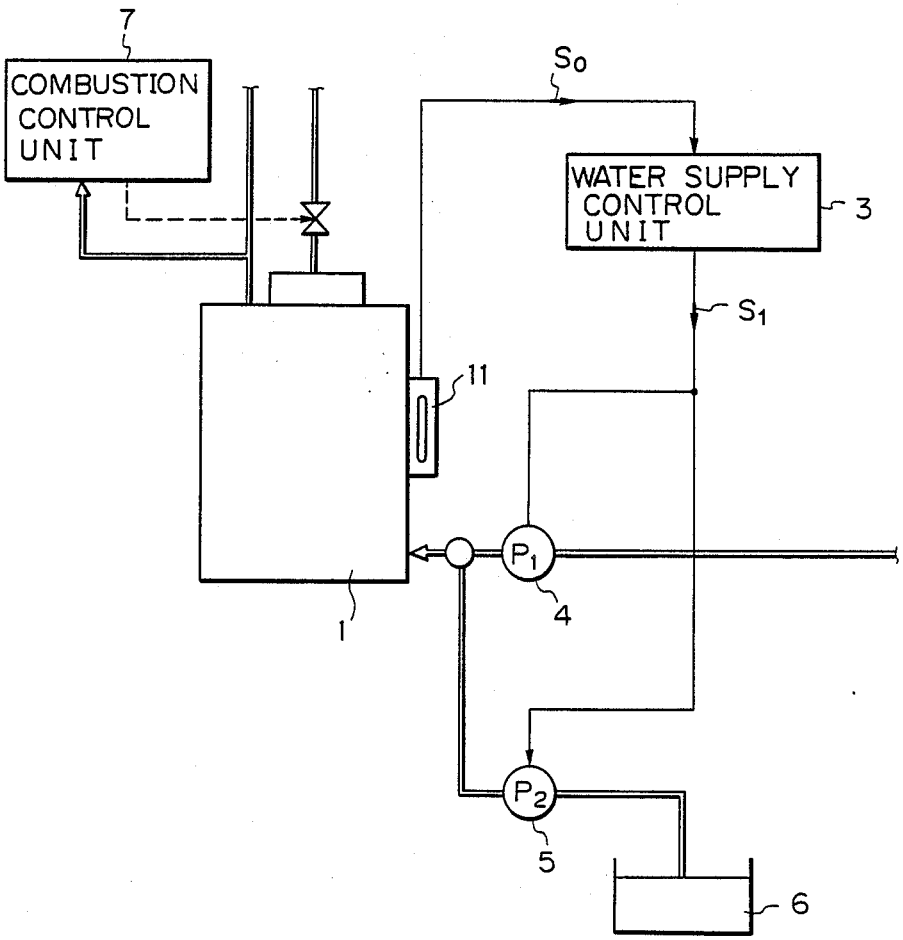
Fig. 1 PRIOR ART
FIG. 1 is a block diagram illustrating the constitution of a background art.
Figure 2:
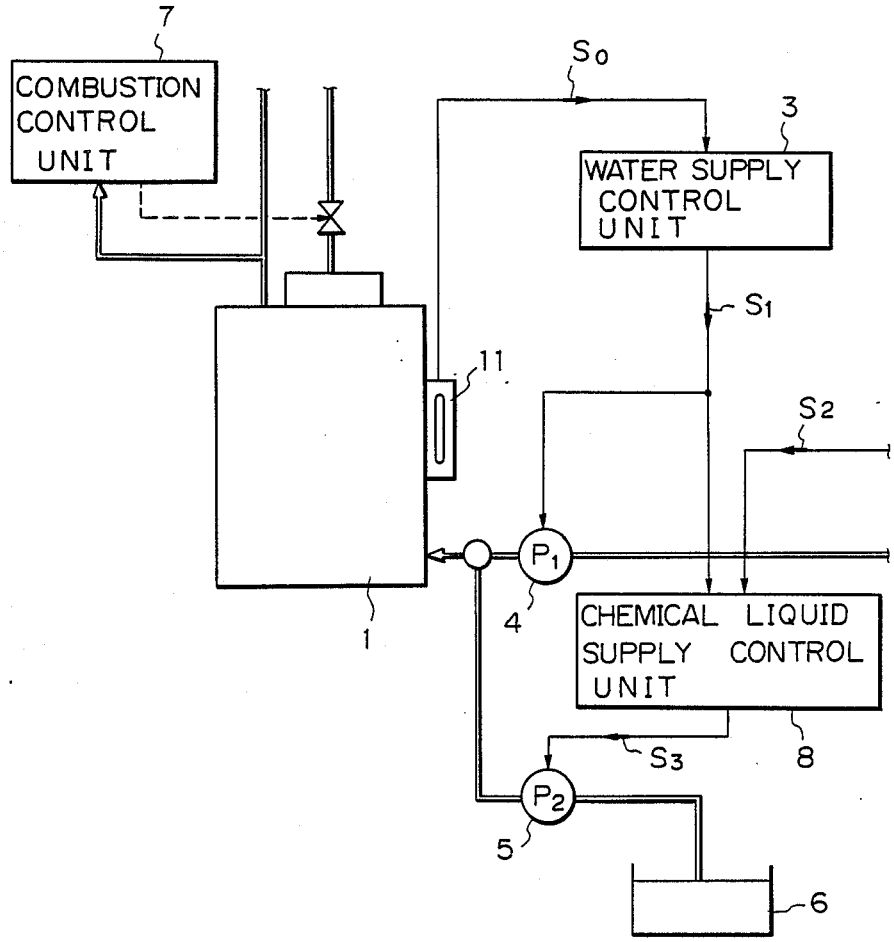
FIG. 2 is a block diagram showing the constitution of an embodiment of the present invention.

FIG. 2 illustrates a block diagram of the constitution of an embodiment. A water filling signal S2 can be supplied to a chemical liquid supply control unit 8, while a water supply signal S1 can be supplied from a water supply control unit 3 to a water supplying pump 4 and the chemical liquid control unit 8. A chemical liquid injection signal S3 can be supplied from the chemical liquid supply control unit 8 to a chemical liquid pump 5.

Figure 3:
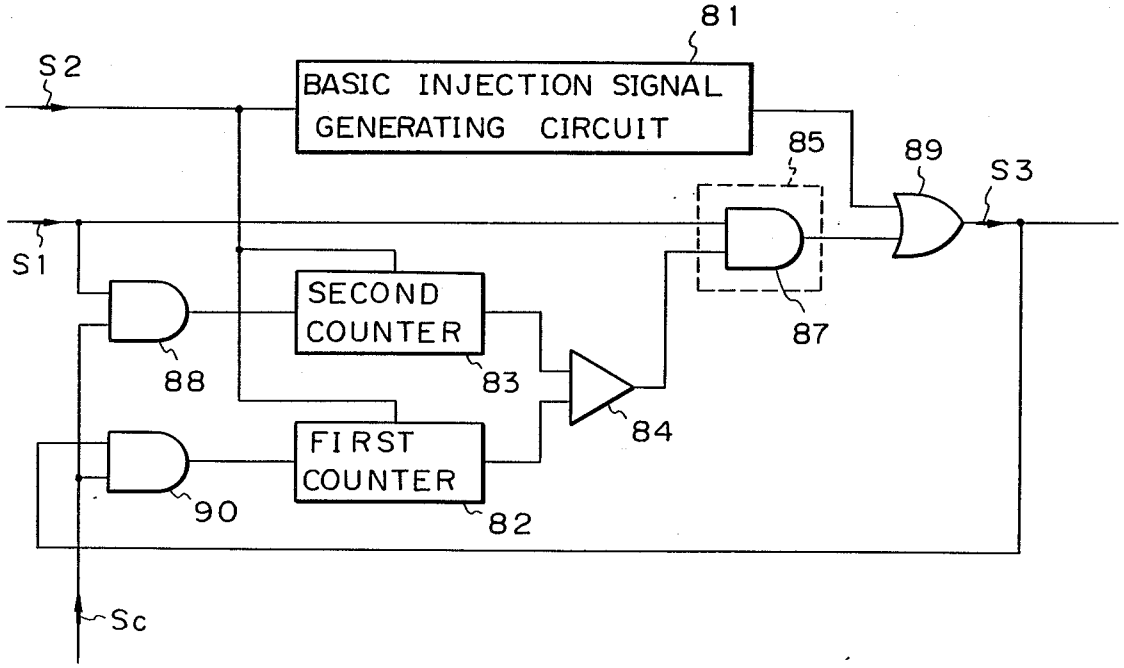
FIG. 3 is a block diagram illustrating the principal portions thereof.

FIG. 3 is a block diagram illustrating in greater detail the construction of the chemical liquid supply control unit 8. The water filling signal S2 is led to a basic injection signal generating circuit 81 defined as chemical liquid basic injection control means and further to a reset terminal of a first counter 82 defined as basic injection period storing means and of a second counter 83 defined as accumulative operating period measuring means. Output signals of the first and second counters 82 and 83 are introduced to a digital comparator 84 defined as time comparing means. A comparison output of the comparator 84 is input to chemical liquid supply stopping means 85. The chemical liquid supply stopping means 85 includes an AND gate 87 having one input terminal to which the comparison output of the comparator 84 is applied. To the other input terminal of the AN gate 87 the water supply signal S1 is applied. The water supply signal S1 is also given to one input terminal of an AND gate 88 for intermitting a counting action of the second counter 83. An AND output of this input signal and a clock signal Sc applied to the other input terminal of the AND gate 88 is supplied to the second counter 83. An output signal of the basic injection signal generating circuit 81 to which the water filling signal S2 is supplied and an AND output from the AND gate 87 of the chemical liquid supply stopping means 85 are led to an OR gate 89. A chemical liquid injection signal S3 is output from the OR gate 89 and is given to one input terminal of an AND gate 90 for intermitting the counting action of the first counter 82. An AND output of this input signal and the clock signal Sc applied to the other input terminal of the AND gate 90 is supplied to the first counter 82.

The operation of the above-described embodiment will be explained in conjunction with FIGS. 2 to 4.

Figure 4:
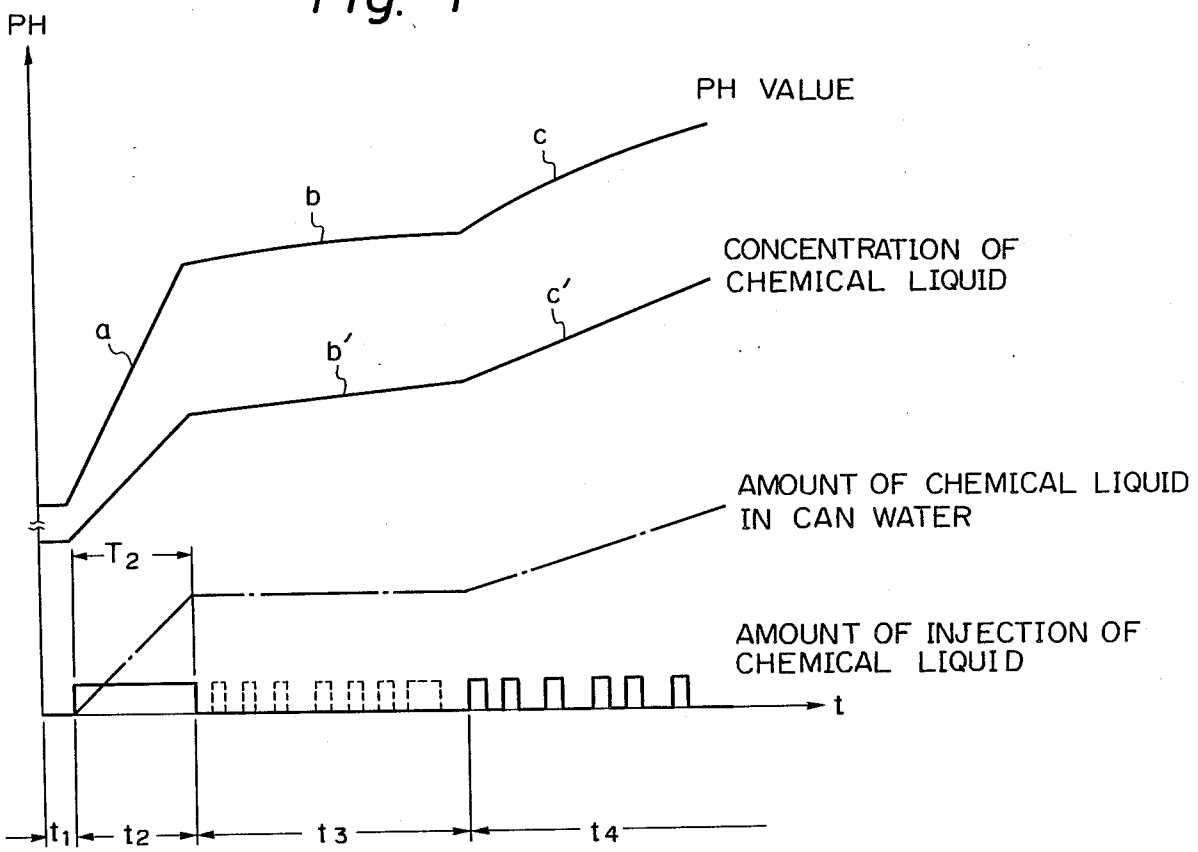
FIG. 4 is an operational characteristic diagram thereof.

FIG. 4 is an operational characteristic diagram of the embodiment, where the axis of abscissas indicates time, while the axis of ordinate indicates the pH value of can water, the concentration of chemical liquid, the amount of chemical liquid in the can water and the amount of injection of chemical liquid.

To start with, for instance, when the boiler 1 is filled with the can water (the period t1 of FIG. 4), the first and second counters 82 and 83 of the chemical liquid supply control unit 8 are simultaneously reset by the water filling signal S2. In response to the water filling signal S2, the basic injection signal generating circuit 81 typically comprising a monostable multivibrator generates a chemical liquid injection signal S3 which continues only for the preset basic injection period T2. This chemical liquid injection signal S3 is supplied via the OR gate 89 to the chemical liquid pump 5. Then, the chemical liquid pump begins to function, and the chemical liquid is injected from the chemical liquid tank 6 into the can water. As a result, the pH value of can water increases up to a proper value (a of FIG. 4).

In this meantime, since the gate 90 is opened by the chemical liquid injection signal S3, the first counter 82 counts the clock signals So passing through this gate 90, whereby enabling the counter 82 to store the basic injection period T2 as a digital code.

Subsequently, as the boiler 1 consumes steam during operation, the water supply signal S1 from the water supply control unit 3 is supplied to the water supply pump 4 and the chemical liquid supply control unit 8. In response to this, the water supply pump 4 intermittently supplies the can water so that the level of can water falls within the range of upper and lower limit values. At this time, since the AND gate 88 is opened by the water supply signal S1 supplied to the chemical liquid supply control unit 8, the second counter 83 counts the clock signals Sc passing therethrough. The second counter 83 clocks the accumulative operating period T3 of the water supply pump 4 and indicates the period as a digital code. The comparator 84 compares the digital code indicating the basic injection period T2 stored in the first counter 82 with the digital code indicating the accumulative operating period T3 given from the second counter 83, and, if the accumulative operating period T3 is smaller than the basic injection period T2, outputs "0" to supply it to the chemical liquid supply stopping means 85.

Then, since the output "0" is led to the AND gate 87 and closes the AND gate 87, the AND gate 87 does not permit the passage of the water supply signal S1 which comes in the period of duration (the period t3 of FIG. 4) of the water supply signal S1 subsequent to the period of duration (the period t2 of FIG. 4) of the chemical liquid injection signal S3 transmitted from the basic injection signal generating circuit 81. Therefore, the water supply pump 4 is intermittently operated in response to the water supply signal S1 for the duration of that period (the period t3 of FIG. 4), thereby the supply of the chemical liquid injection signal S3 to the chemical liquid pump 5 is cut off even if the can water is being supplied to the boiler, and the interlocking control of the water supply pump 4 and the chemical liquid pump 5 is inhibited. Accordingly, the chemical liquid pump 5 is not activated in this period. As a result, the pH value of can water and the concentration of chemical liquid continue to rise merely moderately (b and b' of FIG. 4).

During this period the AND gate 88 is opened at every intermittent period of the water supply signal S1, thus permitting the clock signals Sc to pass to the second counter 83, by which the accumulative duration of the water supply signal S1, i.e., the accumulative operating period T3 of the water supply pump 4 is clocked. The digital code indicating the accumulative operating period T3 is output from the second counter 83, is then supplied to the digital comparator 84 and is compared with the digital code indicating the period of duration (the period t2 of FIG. 4) of the chemical liquid injection signal S3 at the time of the basic injection, viz., the basic injection period T2 already stored in the first counter 82.

Just when the increasing accumulative operating period T3 coincides with the basic injection period, the output of the digital comparator 84 is changed to "1", by which the AND gate 87 is opened. Thereafter (the period t4 of FIG. 4), the water supply signal S1 is supplied as the chemical liquid injection signal S3 to the chemical liquid pump 5.

Thus the apparatus decides the accumulative operating period T3 of the chemical liquid pump 5 which may be needed if the chemical liquid pump 5 injects the amount of chemical liquid equal to the total quantity of chemical liquid that has already been injected in the boiler by the chemical liquid pump 5 for the basic injection period T2 (the period t2 of FIG. 4) under the interlocking control of the water supply pump 4 and the chemical liquid pump 5. During the period T3 the chemical liquid pump is halted (the period t3 of FIG. 4), and thereafter (the period t4 of FIG. 4), it is ensured that the water supply pump 4 and the chemical liquid pump 5 are controlled to interlock with each other so as to supplement an amount of chemical liquid lost. Consequently the pH value of can water and the concentration of chemical liquid gradually increase (c and c' of FIG. 4).

In the above-described embodiment, the first counter clocks the basic injection period T2 as the period of duration of the already generated chemical liquid injection signal S3, and stores the basic injection period T2. Alternatively, it is possible that the basic injection signal generating circuit 81 may incorporate a preset counter, which is designed for storing the digital code indicating the basic injection period T2 as the preset value by obtaining the period of duration of the chemical liquid injection signal as the period for which the preset counter clocks the clock pulses from the preset value to zero.

INDUSTRIAL APPLICABILITY

As discussed above, since the present invention is made such that the supply of the chemical liquid after the basic injection period has passed is cut off for a predetermined period, enabling the pH value of can water and the concentration of chemical liquid to be maintained for that period to the values at the time of completing the basic injection, the present invention can exhibit such excellent effects that the excessive corrosion attributed to the operation at high pH value of can water in case of high load and the carry-over derived from the concentration of can water can simultaneously be eliminated, in addition to the fact that the excessive corrosion attributed to the operation at low pH value of can water immediately after being filled can be prevented. The present invention is useful when used in the injection of chemical liquid in the boiler system.

We claim:

1. An apparatus for controlling injection of a chemical liquid in a boiler system comprising:

a water supply control for keeping means level of can water of a boiler to a proper value;

water supply means for supplying can water to said boiler;

chemical liquid supply means controlled by said supply control means so as to interlock with said water supply means for supplying said chemical liquid to said boiler;

a chemical liquid supply control unit, said control unit including:

chemical liquid basic injection control means for driving said chemical liquid supply means for a specific chemical liquid injection period;

basic injection period storing means for setting or clocking said basic injection period for storage;

accumulative operating period measuring means for measuring an accumulative water supply operating period of said water supply means;

time comparing means for comparing said accumulative water supply operating period of said water supply means with chemical liquid said basic injection period stored in said basic chemical liquid injection period storing means; and chemical liquid supply stopping means for stopping the operation of said chemical liquid supply means by inhibiting interlocking control of said chemical liquid supply means and said water supply means by said water supply control means in accordance with a comparison result given by said time comparing means when said accumulative water supply operating period is smaller than said basic chemical liquid injection period.

2. The apparatus for controlling injection of a chemical liquid in a boiler system as in claim 1, wherein said chemical liquid supply stopping means includes a circuit means for receiving a water supply signal from said water supply control means and a compared signal from said time comparing means, and for supplying a liquid injection signal when said compared signal is a result of said accumulative water supply operating period being at least equal to said basic chemical liquid injection period.

* * * * *

UNITED STATES PATENT AND TRADEMARK OFFICE

CERTIFICATE OF CORRECTION

PATENT NO. : 4,903,642

DATED : February 27, 1990

INVENTOR(S) : TAMARU et al

It is certified that error appears in the above-identified patent and that said Letters Patent is hereby corrected as shown below:

On the cover page, Item [75], "Tadao Jujita" should read --Tadao Fujita--.

Signed and Sealed this

Twentieth Day of August, 1991

*Attest:*

*Attesting Officer*

HARRY F. MANBECK, JR.

*Commissioner of Patents and Trademarks*